US010353336B2

(12) United States Patent
Inoue et al.

(10) Patent No.: US 10,353,336 B2
(45) Date of Patent: Jul. 16, 2019

(54) IMAGE FORMING APPARATUS

(71) Applicant: KONICA MINOLTA, INC., Chiyoda-ku, Tokyo (JP)

(72) Inventors: Akira Inoue, Machida (JP); Katsutoshi Sawada, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 112 days.

(21) Appl. No.: 15/622,042

(22) Filed: Jun. 13, 2017

(65) Prior Publication Data

US 2017/0364016 A1 Dec. 21, 2017

(30) Foreign Application Priority Data

Jun. 16, 2016 (JP) ..... 2016-119455

(51) Int. Cl.

| | |
|---|---|
| ***G03G 15/00*** | (2006.01) |
| ***G03G 15/01*** | (2006.01) |
| ***G03G 21/00*** | (2006.01) |
| ***G03G 21/14*** | (2006.01) |
| ***B65H 85/00*** | (2006.01) |

(52) U.S. Cl.

CPC ..... *G03G 15/652* (2013.01); *G03G 15/6523* (2013.01); *G03G 15/6529* (2013.01); *G03G 15/6579* (2013.01); *G03G 2215/00455* (2013.01)

(58) Field of Classification Search

CPC .. G03G 15/00; G03G 15/00455; G03G 15/01; G03G 15/652; G03G 15/6523; G03G 15/6529; G03G 15/6579; G03G 21/00; G03G 21/14; B65H 85/00; B41J 2/315; B41J 2/32; B41J 29/38

See application file for complete search history.

(56) References Cited

U.S. PATENT DOCUMENTS 6,385,432 B1 5/2002 Hanazato et al.
6,411,317 B1 * 6/2002 Fukuda ..... B41J 2/315 347/173

(Continued)

FOREIGN PATENT DOCUMENTS

JP 04149494 A * 5/1992 ..... G03G 15/00
JP 2001305930 A 11/2001
JP 2014015006 A * 1/2014 ..... B41J 15/00

*Primary Examiner* — Nguyen Q. Ha
(74) *Attorney, Agent, or Firm* — Holtz, Holtz & Volek PC

(57) ABSTRACT

An image forming apparatus includes: a conveying unit configured to convey continuous paper in a forward direction and in a reverse direction; an image forming unit configured to form an image on the continuous paper conveyed in the forward direction; a fixing unit configured to fix the image formed onto the continuous paper; an adjusting unit configured to adjust the image forming unit while the continuous paper is conveyed in the reverse direction; and a control unit configured to cause the conveying unit to convey the continuous paper in the reverse direction by an amount equivalent to a predetermined reverse conveyance distance to adjust the bottom edge of the image in a conveying direction to a position on an upstream side of the image forming unit, and cause the conveying unit to convey the continuous paper in the forward direction and cause the image forming unit to resume image formation.

5 Claims, 5 Drawing Sheets

(56) References Cited

U.S. PATENT DOCUMENTS

| | | | | |
|---|---|---|---|---|
| 7,085,526 | B2 * | 8/2006 | Tanimoto | G03G 15/167 399/313 |
| 8,147,023 | B2 * | 4/2012 | Hatada | B41J 11/001 347/101 |
| 8,469,477 | B2 * | 6/2013 | Hiroike | B41J 11/42 347/16 |

* cited by examiner

IMAGE FORMING APPARATUS

The entire disclosure of Japanese Patent Application No. 2016-119455 filed on Jun. 16, 2016 including description, claims, drawings, and abstract are incorporated herein by reference in its entirety.

BACKGROUND OF THE INVENTION

Field of the Invention

The present invention relates to an image forming apparatus.

Description of the Related Art

It is known that, in a conventional electrophotographic image forming apparatus, long continuous paper is used as the recording medium, and an image forming unit forms images on the continuous paper being conveyed. (see JP 2001-305930 A, for example).

In recent years, with the use of such an image forming apparatus, label images are formed (label printing) on label paper that can be attached as stickers.

In regard to label printing, there is a demand for formation of images at shortest possible regular intervals so that the post-processing such as a cutting process and an attaching process can be appropriately performed.

In a case where images are formed on paper sheets that are generally used, adjustment such as resetting the internal counter inside the image forming unit is performed at the timing between pages after the data of a certain amount (one page) is transferred.

In an image forming apparatus that uses continuous paper as disclosed in JP 2001-305930 A, however, there is no such timing of adjustment, and, during the adjustment, the continuous paper is conveyed though the image formation is suspended. As a result, blank areas R appear between images (labels) formed on the continuous paper P as shown in FIG. 7, and images cannot be formed at the shortest possible regular intervals in some cases.

SUMMARY OF THE INVENTION

An object of the present invention is to provide an image forming apparatus that can form images on continuous paper without blank areas appearing between the images.

To achieve the abovementioned object, according to an aspect, an image forming apparatus reflecting one aspect of the present invention comprises: a conveying unit configured to convey continuous paper in a forward direction from an upstream side toward a downstream side and in a reverse direction from the downstream side toward the upstream side; an image forming unit configured to form an image on the continuous paper being conveyed in the forward direction by the conveying unit; a fixing unit configured to fix the image formed by the image forming unit onto the continuous paper; an adjusting unit configured to adjust the image forming unit while the continuous paper is conveyed in the reverse direction by the conveying unit; and a control unit configured to cause the conveying unit to convey the continuous paper the reverse direction by an amount equivalent to a predetermined reverse conveyance distance to adjust the bottom edge of the image in a conveying direction to a position on an upstream side of the image forming unit after the image is fixed onto the continuous paper by the fixing unit, and cause the conveying unit to convey the continuous paper in the forward direction and cause the image forming unit to resume image formation after completion of the conveyance in the reverse direction.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, an embodiment of the present invention will be described with reference to the drawings. However, the scope of the invention is not limited to the illustrated examples.

First, the configuration of an image forming apparatus according to this embodiment is described.

The image forming apparatus 1 is an apparatus that uses long continuous paper (roll paper) P as a recording medium, and forms images on this continuous paper P.

The image forming apparatus 1 forms images on the continuous paper P in accordance with print data that is input from an external device (a personal computer, for example) via a network.

The continuous paper P according to this embodiment is label paper or the like that can be attached as a sticker, for example. The print data is data that includes more than one label image in one page, for example (see FIG. 5). This print data also includes a mark to be used in positioning in the post-processing stage (such as a cutting process and an attaching process) after image formation.

That is, this embodiment is to form label images on long label paper (the continuous paper P). It should be understood that the types of the continuous paper P and the print data are not limited to the above.

Figure 1:
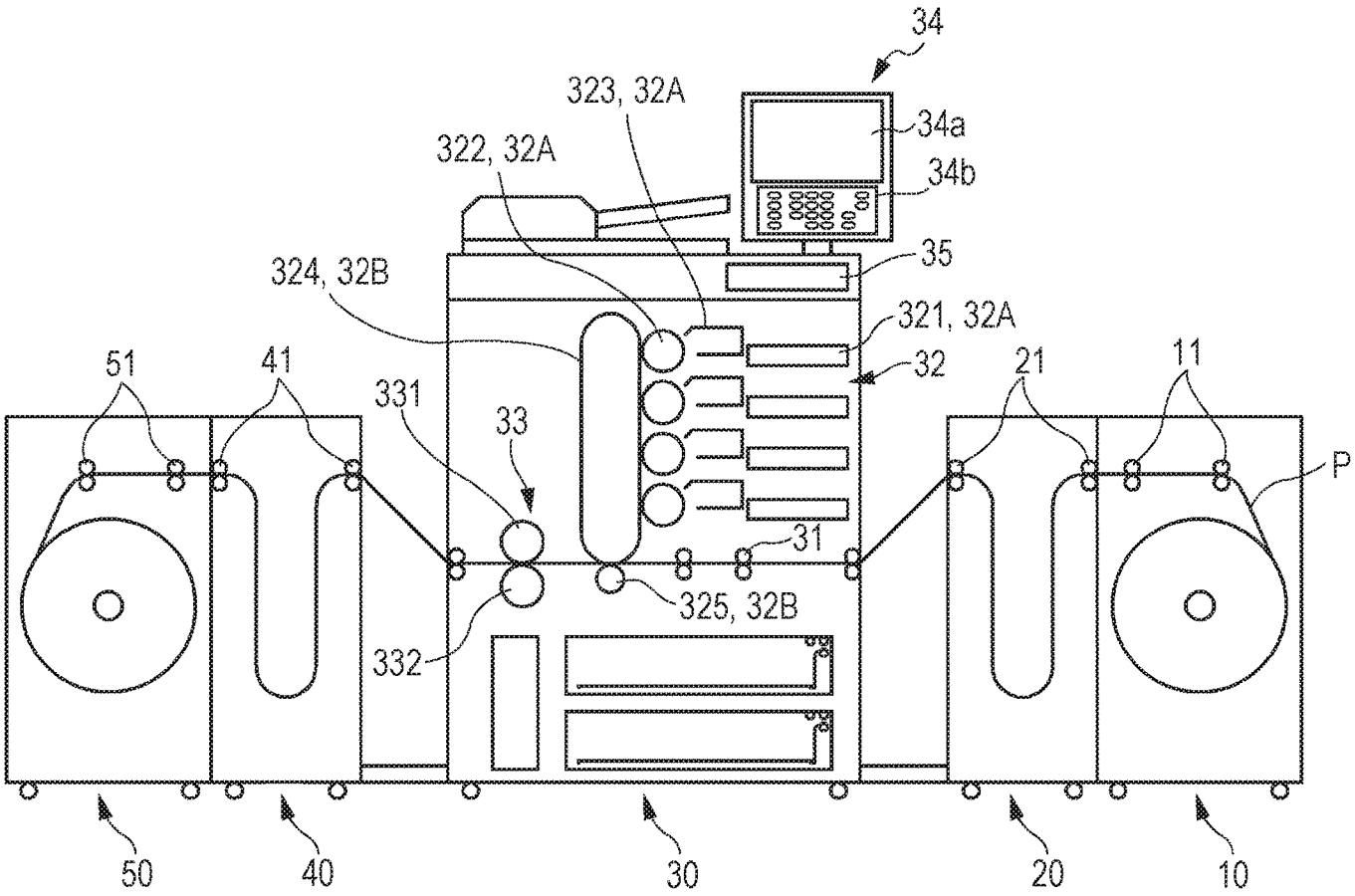
FIG. 1 is a diagram schematically showing the structure of an image forming apparatus according to an embodiment of the present invention.

FIG. 1 is a diagram schematically showing the structure of the image forming apparatus 1.

As shown in FIG. 1, the image forming apparatus 1 is formed by connecting a sheet feeding unit 10, a sheet feed adjusting unit 20, a device main unit 30, a wind adjusting unit 40, and a winding unit 50 in this order from the upstream side in the direction of conveyance of the continuous paper P.

The sheet feeding unit 10 supplies continuous paper P to the device main unit 30. In the housing of the sheet feeding unit 10, a roll of continuous paper P is wound around a support shaft and is held in a rotatable manner, as shown in FIG. 1. In the sheet feeding unit 10, the continuous paper P wound around the support shaft is conveyed to the outside at a constant speed by conveyance rollers 11. Although only one roll of continuous paper P is shown in FIG. 1, rolls of continuous paper P might be stored in the sheet feeding unit 10.

The sheet feed adjusting unit 20 is disposed on the downstream side of the sheet feeding unit 10 and on the upstream side of the device main unit 30 in the direction of conveyance of the continuous paper P. The sheet feed adjusting unit 20 is a mechanism that conveys the continuous paper P from the sheet feeding unit 10 to the device main unit 30 with conveyance rollers 21. To absorb a difference between the speed of conveyance of the continuous paper P in the sheet feeding unit 10 and the speed of conveyance of the continuous paper P in the device main unit 30, the sheet feed adjusting unit 20 holds the continuous paper P in a slack state, and adjusts the feeding of the continuous paper P into the device main unit 30.

The device main unit 30 has a function to form images on the continuous paper P. The device main unit 30 is disposed on the downstream side of the sheet feed adjusting unit 20 and on the upstream side of the wind adjusting unit 40 in the direction of conveyance of the continuous paper P.

The wind adjusting unit 40 is disposed on the downstream side of the device main unit 30 and on the upstream side of the winding unit 50 in the direction of conveyance of the continuous paper P. The wind adjusting unit 40 is a mechanism that conveys the continuous paper P from the device main unit 30 to the winding unit 50 with conveyance rollers 41. To absorb a difference between the speed of conveyance of the continuous paper P in the device main unit 30 and the speed of conveyance of the continuous paper P in the winding unit 50, the wind adjusting unit 40 holds the continuous paper P in a slack state, and adjusts the discharging of the continuous paper P from the device main unit 30.

The winding unit 50 winds up the continuous paper P conveyed from the device main unit 30 via the wind adjusting unit 40. In the housing of the winding unit 50, the continuous paper P is wound around a support shaft and is held in the form of a roll, as shown in FIG. 1. In the winding unit 50, the continuous paper P conveyed from the wind adjusting unit 40 is wound around the support shaft at a constant speed by conveyance rollers 51.

In this embodiment, under the control of the control unit 35 (described later) of the device main unit 30, the rotational directions of the conveyance rollers 11, 21, 41, and 51 of the above described units are switched so that the conveyance rollers 11, 21, 41, and 51, together with the conveyance rollers 31 (described later) of the device main unit 30, can convey the continuous paper P in the forward direction from the upstream side toward the downstream side or in the reverse direction from the downstream side toward the upstream side.

Next, the configuration of the device main unit 30 is described in detail.

Figure 2:
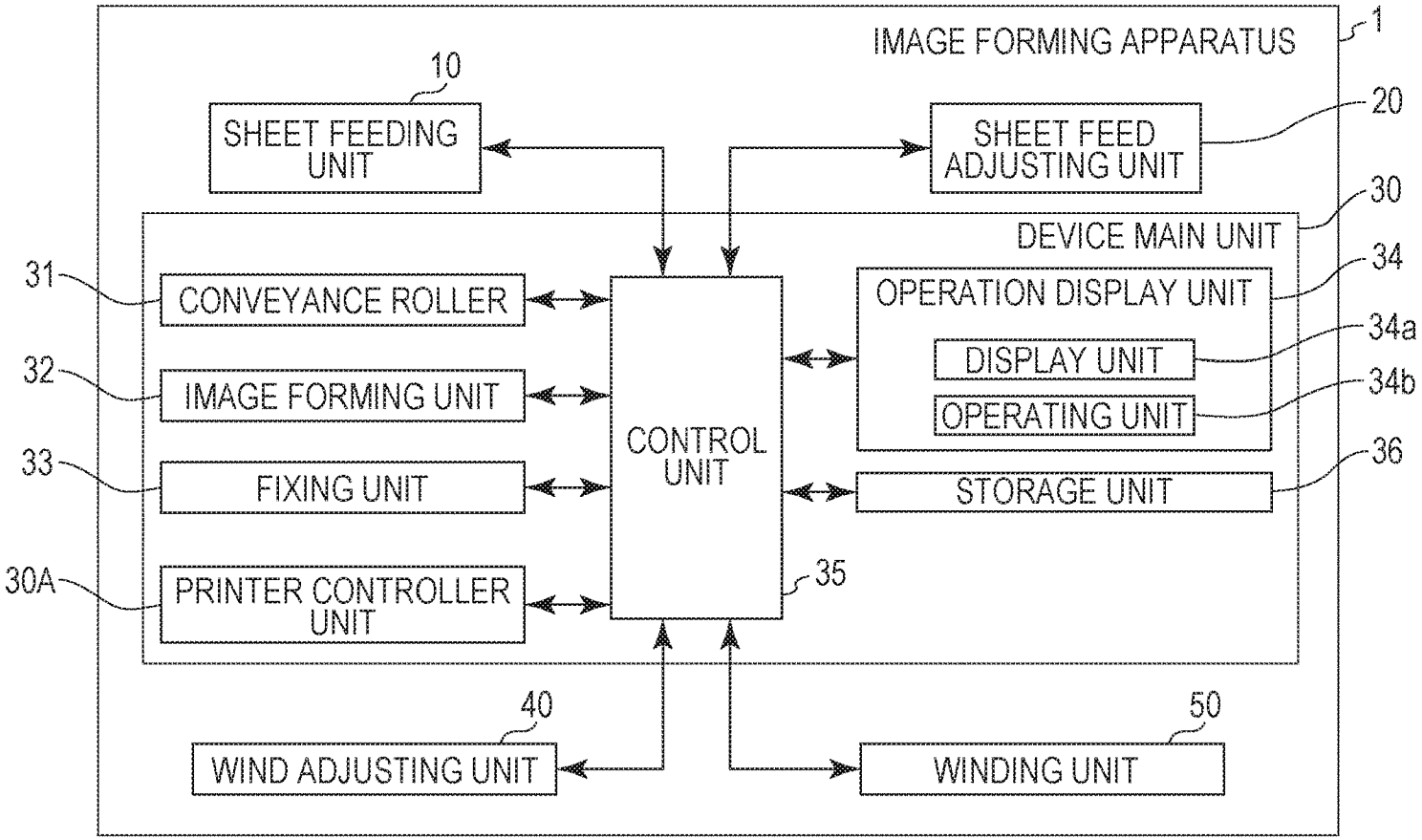
FIG. 2 is a functional block diagram showing the control configuration of the image forming apparatus.

FIG. 2 is a block diagram showing the control configuration of the image forming apparatus 1.

As shown in FIG. 2, the device main unit 30 includes a printer controller unit 30A, the conveyance rollers 31, an image forming unit 32, a fixing unit 33, an operation display unit 34, the control unit 35, and a storage unit 36.

The printer controller unit 30A manages and controls information that is input to the image forming apparatus a from an external device such as a personal computer connected to a network like a local area network (LAN). The printer controller unit 30A receives print data from an external device, and performs processing such as rasterizing on the received data, to convert the received data into image data from which images can be formed. The image forming unit 32 is controlled in accordance with this image data.

The conveyance rollers 31 are provided inside the device main unit 30, and convey the continuous paper P, which has been conveyed from the sheet feed adjusting unit 20, in the forward direction from the image forming unit 32 toward the wind adjusting unit 40 via the fixing unit 33.

Under the control of the control unit 35, the rotational directions of the conveyance rollers 31 are switched so that the conveyance rollers 31, together with the conveyance rollers 11, 21, 41, and 51 of the above described units, can convey the continuous paper P in the reverse direction. With this, the conveyance rollers 31 and the conveyance rollers 11, 21, 41, and 51 of the respective units function as a conveying unit.

In accordance with the image data sent from the printer controller unit 30A, the image forming unit 32 forms an image on the continuous paper P being conveyed in the forward direction from the upstream side toward the downstream side.

The image forming unit 32 forms a toner image by an electrophotographic method. The image forming unit 32 includes an image formation unit 32A that forms a toner image in accordance with the image data, and a transfer unit 32B that transfers the toner mage onto the continuous paper P (see FIG. 1).

The image formation unit 32A includes four sets of an exposing unit 321, a photosensitive member 322, and a developing unit 323. These four sets correspond to the respective color components of yellow (Y), magenta (M), cyan (C), and black (K). The transfer unit 32B includes an intermediate transfer belt 324 and a transfer roller 325.

The exposing unit 321 irradiates and exposes the charged photosensitive member 322 with laser light, and forms an electrostatic latent image on the photosensitive member 322. The developing unit 323 supplies toner of a predetermined color (one of Y, M, C, and K) onto the charged photosensitive member 322 with a developing roller, and develops the electrostatic latent image formed on the photosensitive member 322.

Toner images (single-color images) in the respective colors formed on the photosensitive members 322 corresponding to the respective colors of Y, M, C, and K are sequentially transferred onto the intermediate transfer belt 324. As the layers of the respective colors overlap on one another, a toner image (a color image) is formed. The intermediate transfer belt 324 is an endless belt that is wound around rollers. A bias voltage of the opposite polarity from that of the toner is applied to the transfer roller 325, so that the toner image formed on the intermediate transfer belt 324 are transferred onto the continuous paper P.

The fixing unit 33 fixes the toner image transferred onto the continuous paper P.

The fixing unit 33 includes a pair of rollers for nipping the continuous paper P. The pair of rollers are formed with a heating roller 331 and a pressure roller 332 (see FIG. 1).

The heating roller 331 is heated to a predetermined temperature by a heater that serves as a heat source.

The pressure roller 332 is pressed against the heating roller 331 by an elastic member (not shown). The continuous paper P onto which the toner image has been transferred is subjected to heat and pressure, passing through the nip portion between the heating roller 331 and the pressure roller 332. Consequently, the toner image is melted and fixed onto the continuous paper P.

The operation display unit 34 includes a display unit 34*a* that displays various kinds of information on a display screen, and an operating unit 34*b* to be used in inputting various commands by the user. The operating unit 34*b* may include a touch panel formed to cover the display screen of the display unit 34*a*.

The control unit 35 is formed with a central processing unit (CPU), a random access memory (RAM), and the like. The CPU of the control unit 35 reads various programs, such as a system program and a processing program, from the storage unit 36, and loads the programs into the RAM. In accordance with the loaded programs, the control unit 35 performs various kinds of processing.

For example, the control unit 35 performs an image formation process on the continuous paper P.

In the image formation process of this embodiment, the control unit 35 causes the fixing unit 33 to fix the current image onto the continuous paper P, and then causes the conveying unit to convey the continuous paper P a predetermined reverse conveyance distance in the reverse direction so that the bottom edge of the current image in the conveying direction is located on the upstream side of the image forming unit 32. After the completion of the conveyance in the reverse direction, the control unit 35 causes the conveying unit to convey the continuous paper P in the forward direction, and causes the image forming unit 32 to resume image formation. The control unit 35 also functions as an adjusting unit, and adjusts the image forming unit 32 during the conveyance of the continuous paper P in the reverse direction.

This image formation process will be described later in detail.

The storage unit 36 is formed with a hard disk drive (HDD) or a nonvolatile semiconductor memory, for example.

The storage unit 36 stores various programs such as the system program and the processing program to be executed by the control unit 35, and the data necessary for executing these programs.

Next, an operation to be performed by the image forming apparatus 1 is described.

The image forming apparatus 1 forms label images on long label paper (continuous paper P) in accordance with print data including more than one label image in one page. In this embodiment, the control unit 35 performs control to prevent formation of blank areas between pages.

Figure 3:
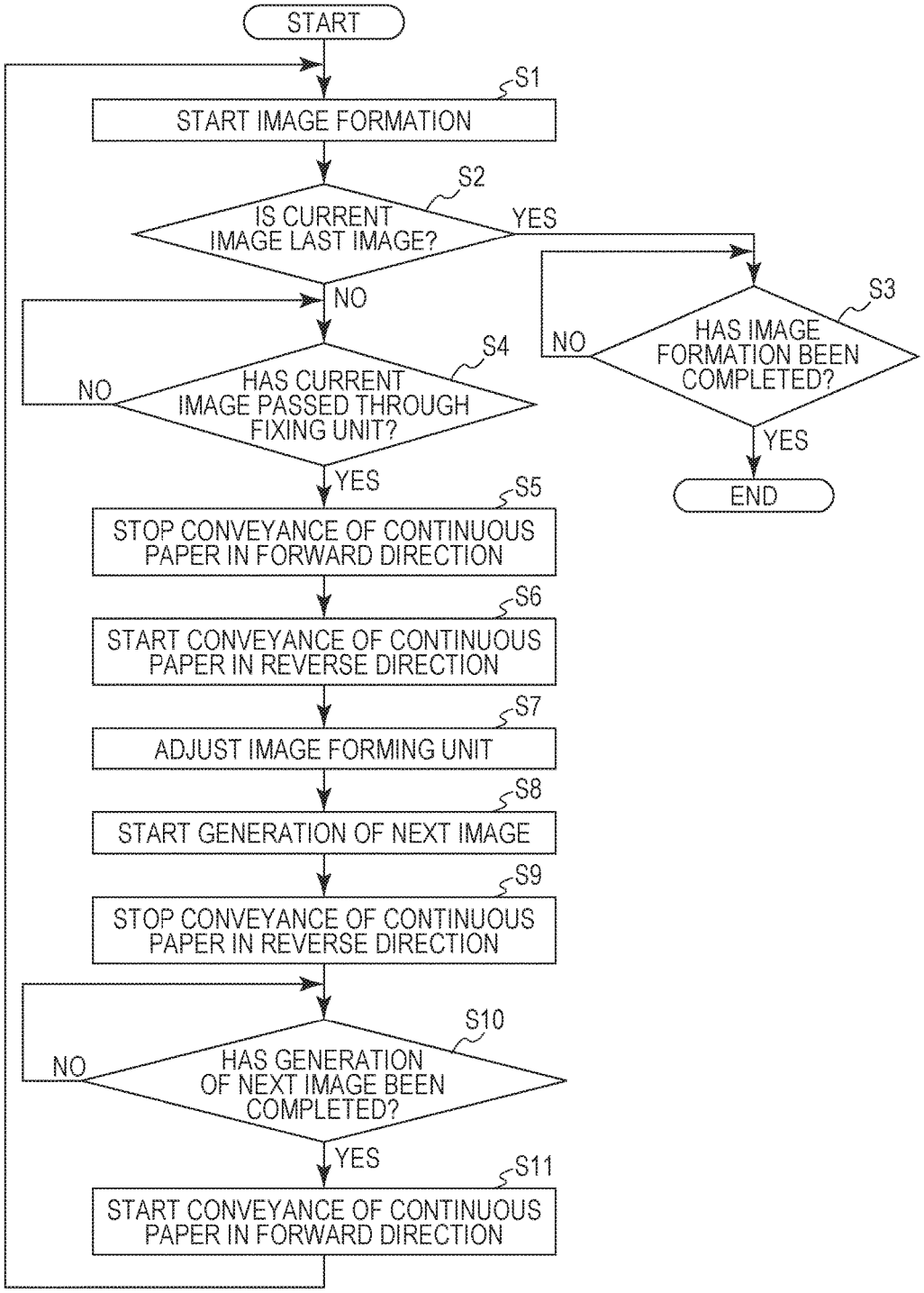
FIG. 3 is a flowchart showing an image formation process according to the embodiment of the present invention.
Figure 4:
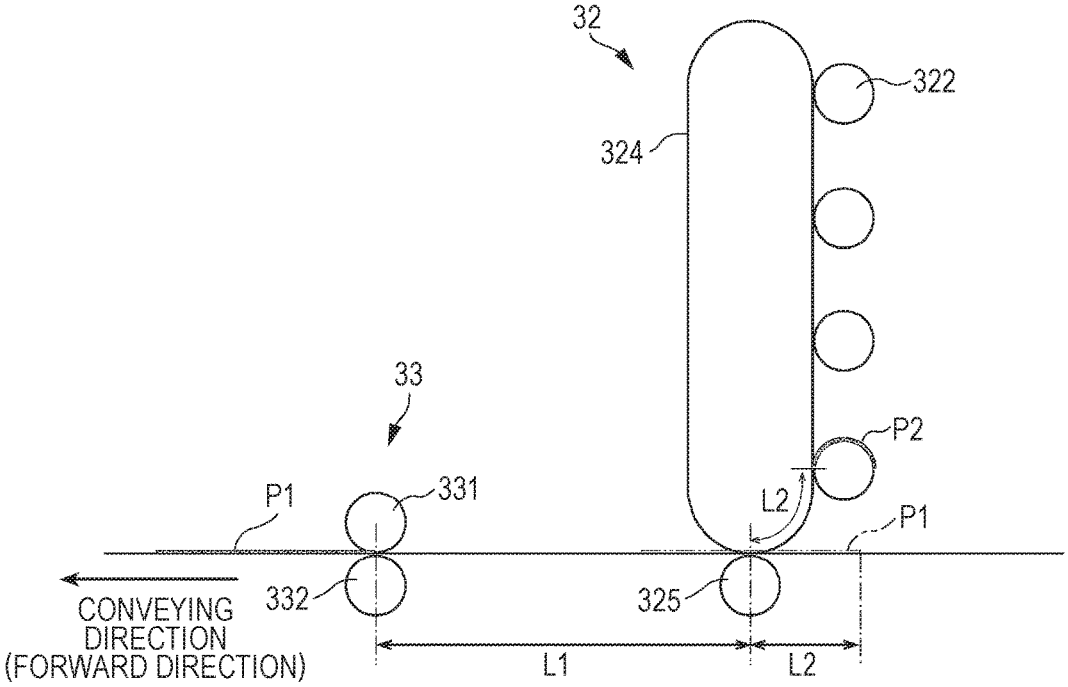
FIG. 4 is a diagram for explaining operation of the image forming apparatus.

FIG. 3 is a flowchart showing an image formation process to be performed by the image forming apparatus 1. FIG. 4 is a diagram for explaining movement of the continuous paper P in this image formation process.

First, when the image forming unit 32 starts forming an image of a page on the continuous paper P being conveyed in the forward direction by the conveying unit (step S1), the control unit 35 determines whether the image is the last image (step S2).

If the image is the last image (step S2: YES), the control unit 35 determines whether the image formation has been completed (step S3). If the image formation has not been completed yet (step S3: NO), the control unit 35 repeats this procedure in step S3. If the image formation has been completed (step S3: YES), the control unit 35 ends this process.

If the image is not the last image (step S2: NO), on the other hand, the control unit 35 determines whether the formed image has passed through the fixing unit 33 (step S4). If the formed image has not passed through the fixing unit 33 yet (step S4: NO), the control unit 35 repeats this procedure in step S4. That is, the control unit 35 repeats this procedure until the bottom edge of the formed image passes through the nip portion between the heating roller 331 and the pressure roller 332.

If the formed image has passed through the fixing unit 33 (step S4: YES), on the other hand, the control unit 35 stops the conveyance of the continuous paper P in the forward direction (step S5).

As a result, the conveyance of the continuous paper P in the forward direction is stopped, with the bottom edge of an image P1 formed on the continuous paper P having passed through the nip portion between the heating roller 331 and the pressure roller 332, as shown in FIG. 4.

The control unit 35 then causes the conveying unit to start conveyance of the continuous paper P in the reverse direction (step S6). While the continuous paper P is conveyed in the reverse direction, no images are formed on the continuous paper P.

Here, the reverse conveyance distance over which the continuous paper P is conveyed in the reverse direction is the sum of the distance (first distance) L1 from the nip portion between the intermediate transfer belt 324 and the transfer roller 325 to the nip portion between the heating roller 331 and the pressure roller 332, and the distance (second distance) L2 from the point of transfer of the toner image onto the intermediate transfer belt 324 to the transfer roller 325, as shown in FIG. 4.

In a case where an image in multiple colors is to be formed, the "point of transfer of the toner image onto the intermediate transfer belt 324" is the point of transfer of the last toner image to be transferred onto the intermediate transfer belt 324.

Accordingly, as indicated by a two-dots-and-dash line in FIG. 4, the image P1 formed on the continuous paper P is returned toward the upstream side in the conveying direction by the amount equivalent to the reverse conveyance distance (the distance L1+the distance L2), and the bottom edge of the image P1 reaches a predetermined position on the upstream side of the image forming unit 32.

The control unit 35 then performs predetermined adjustment such as resetting the internal counter in the image forming unit 32 (step S7), receives image data sent from the printer controller unit 30A, and starts toner images formation on the photosensitive members 322 (step S8).

When the conveyance distance of the continuous paper P in the reverse direction reaches the predetermined reverse conveyance distance, the control unit 35 stops the conveyance of the continuous paper P in the reverse direction (step S9).

The control unit 35 then determines whether the toner image formation has progressed to a predetermined degree (step S10). If the toner image formation has not yet progressed to the predetermined degree (step S10: NO), the control unit 35 repeats this procedure in step S10.

If the toner image formation has progressed to the predetermined degree (step S10: YES), the control unit 35 starts conveyance of the continuous paper P in the forward direction when transfer of the toner images onto the intermediate transfer belt 324 is started (step S11). After that, the control unit 35 returns to step S1, and repeats the above procedures.

As a result, immediately after the bottom edge of the image P1 formed on the continuous paper P again passes through the nip portion between the intermediate transfer belt 324 and the transfer roller 325, transfer of the image P2 to be formed next onto the continuous paper P is started.

Figure 5:
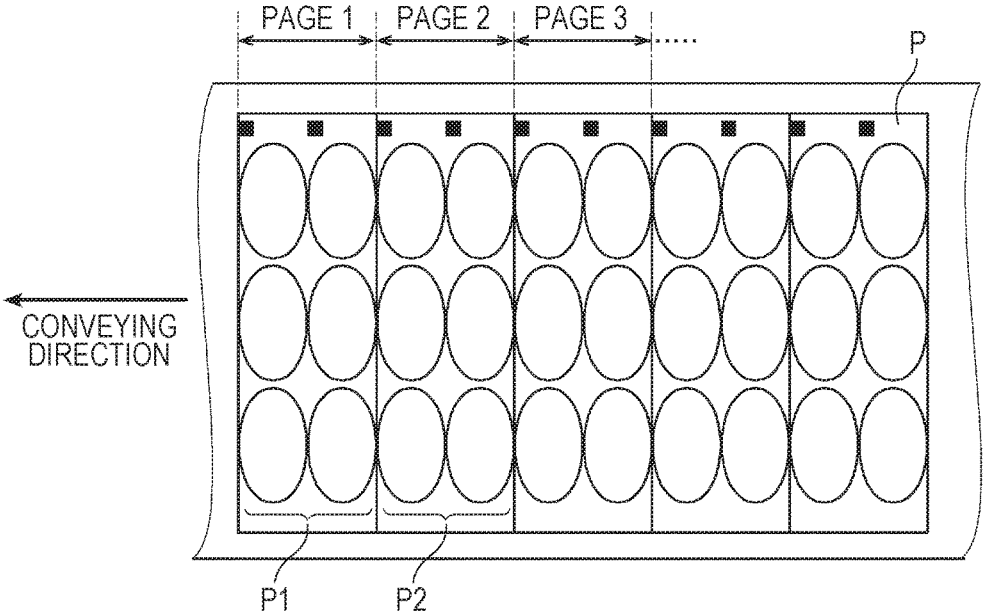
FIG. 5 is a diagram showing an example of continuous paper on which images are formed.

FIG. 5 shows an example of images formed through the above described image formation process.

As shown in FIG. 5, through the above described image formation process, images are continuously formed, without blank areas appearing between images.

As described above, according to this embodiment, an image forming apparatus includes: the conveying unit (the conveyance rollers 11, 21, 31, 41, and 51) that can convey continuous paper P in the forward direction from the upstream side toward the downstream side and in the reverse direction from the downstream side toward the upstream side; the image forming unit 32 that forms an image on the continuous paper P being conveyed in the forward direction by the conveying unit; the fixing unit 33 that fixes the image formed by the image forming unit 32 onto the continuous paper P; and the control unit 35 that adjusts the image forming unit 32 while the continuous paper P is conveyed in the reverse direction by the conveying unit. After the image is fixed onto the continuous paper P by the fixing unit 33, the control unit 35 causes the conveying unit to convey the continuous paper P in the reverse direction by the amount equivalent to a predetermined reverse conveyance distance so that the bottom edge of the image in the conveying direction is located on the upstream side of the image forming unit 32. After the completion of the conveyance in the reverse direction, the control unit 35 causes the conveying unit to convey the continuous paper P in the forward direction, and causes the image forming unit 32 to resume image formation.

Accordingly, after an image is fixed onto the continuous paper P, the continuous paper P is conveyed in the reverse direction, and in the meantime, the image forming unit 32 is adjusted. Thus, images can be continuously formed on the continuous paper P, without blank areas appearing between the images.

Also, according to this embodiment, the image forming unit 32 includes: the image formation unit 32A that forms a toner image in accordance with image data; and the transfer unit 32B that transfers the toner image onto the continuous paper P. The control unit 35 causes the image formation unit 32A to form a toner image of the next image while the continuous paper P is conveyed in the reverse direction by the conveying unit.

As a toner image of the next image is formed during the conveyance in the reverse direction, image formation on the continuous paper P can be resumed immediately after completion of the conveyance in the reverse direction.

Further, according to this embodiment, after the completion of the conveyance in the reverse direction, the control unit 35 changes the timing to start conveyance of the continuous paper P in the forward direction after completion of conveyance in the reverse direction, in accordance with the degree of progress in formation of a toner image of the next image.

Thus, in a case where formation of a toner image of the next image has not progressed or where formation of a toner image of the next image is not to be completed in time after completion of conveyance in the reverse direction, the conveyance of the continuous paper P can be stopped, and the continuous paper P can be made to stand by for resumption of image formation on the continuous paper P.

Also, according to this embodiment, the image forming unit 32 includes: the image formation unit 32A that forms a toner image in accordance with image data; and the transfer unit 32B that transfers the toner image onto the continuous paper P. The reverse conveyance distance is the sum of the distance L1 between the fixing unit 33 and the image forming unit 32, and the distance L2 from the point of transfer of the toner image formed by the image formation unit 32A to the transfer unit 32B, to the point of transfer of the toner image onto the continuous paper P.

In this case, after reverse conveyance, conveyance of the continuous paper P in the forward direction is started when a toner image of the next image is transferred onto the intermediate transfer belt 324. As a result, transfer of the image P2 to be formed next onto the continuous paper P is started immediately after the bottom edge of the image P1 formed on the continuous paper P passes through the nip portion between the intermediate transfer belt 324 and the transfer roller 325.

In the above described example of an image formation process according to this embodiment, the predetermined reverse conveyance distance is equal to the sum of the distance L1 and the distance L2. However, the reverse conveyance distance is not limited to that, as long as it is such a distance that the continuous paper P can be conveyed in the reverse direction to move the bottom edge of the image fixed onto the continuous paper P to a position on the upstream side of the image forming unit 32 in the conveying direction.

For example, in a case where control is performed to stop conveyance of the continuous paper P in the forward direction when the bottom edge of the image fixed onto the continuous paper P in the conveying direction advances and moves away from the nip portion of the fixing unit 33 by a predetermined distance, the predetermined distance may be added to the reverse conveyance distance.

Also, in the example process according to the above described embodiment, continuous images are formed successively on the continuous paper P without any blank areas. However, images associated with each other (such as a frame and the pattern inside the frame) can be successively formed to overlap each other on the continuous paper P.

Figure 6:
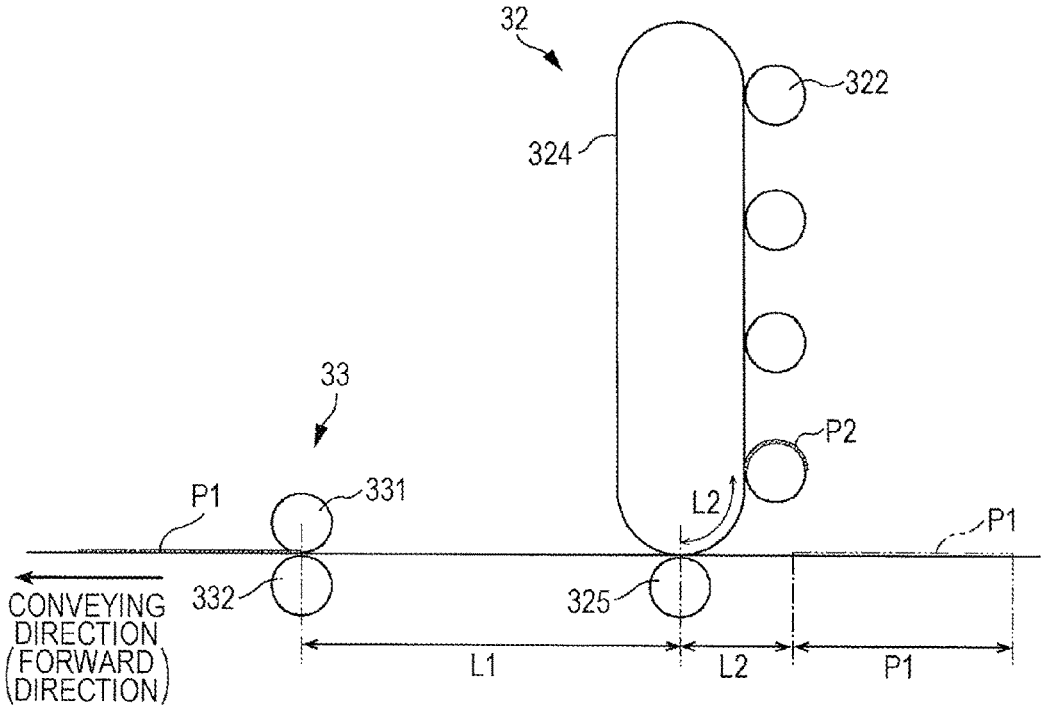
FIG. 6 is a diagram for explaining a modification of the operation of the image forming apparatus.
Figure 7:
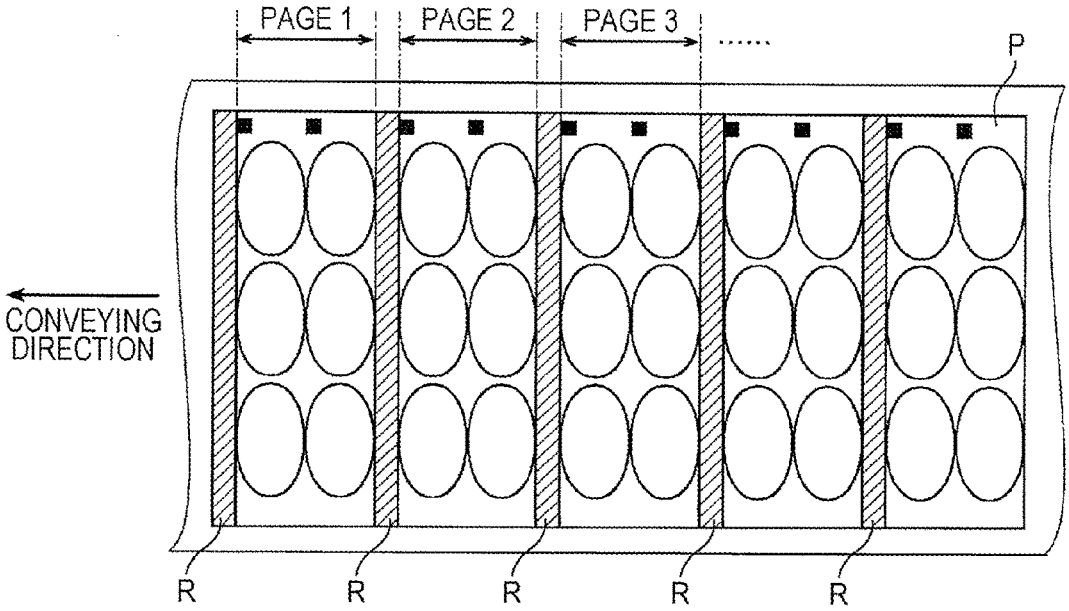
FIG. 7 PRIOR ART
FIG. 7 is a diagram for explaining a problem in a conventional art.

In this case, the reverse conveyance distance is the sum of the distance L1, the distance L2, and the length of the first image P1 in the conveying direction, as shown in FIG. 6.

As a result, when image formation is resumed after the conveyance in the reverse direction, transfer of the image P2 to be formed next onto the continuous paper P is started when the top edge of the first image P1 reaches the nip portion between the intermediate transfer belt 324 and the transfer roller 325. Thus, the two images can be formed in an overlapping manner.

It should be noted that the number of images to overlap is not necessarily two.

In the above described embodiment, the continuous paper P is label paper. However, the continuous paper P may of course be any paper other than label paper.

Further, the device main unit 30 may be a multi-function peripheral (MFP) that has a copy function, a scan function, a facsimile function, and the like, in addition to the image formation function.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

a conveying unit configured to convey continuous paper in a forward direction from an upstream side toward a downstream side and in a reverse direction from the downstream side toward the upstream side;

an image forming unit configured to form a first image on the continuous paper being conveyed in the forward direction by the conveying unit;

a fixing unit configured to fix the first image formed by the image forming unit onto the continuous paper;

an adjusting unit configured to adjust the image forming unit while the continuous paper is conveyed in the reverse direction by the conveying unit; and a control unit configured to cause the conveying unit to convey the continuous paper in the reverse direction by an amount equivalent to a predetermined reverse conveyance distance to adjust a bottom edge of the first image in a conveying direction to a position on an upstream side of the image forming unit after the first image is fixed onto the continuous paper by the fixing unit, and thereafter cause the conveying unit to convey the continuous paper in the forward direction and cause the image forming unit to form a second image on the continuous paper at a position adjacent to the first image after completion of the conveyance in the reverse direction.

2. An image forming apparatus according to claim 1, comprising:

a conveying unit configured to convey continuous paper in a forward direction from an upstream side toward a downstream side and in a reverse direction from the downstream side toward the upstream side;

an image forming unit configured to form an image on the continuous paper being conveyed in the forward direction by the conveying unit;

a fixing unit configured to fix the image formed by the image forming unit onto the continuous paper;

an adjusting unit configured to adjust the image forming unit while the continuous paper is conveyed in the reverse direction by the conveying unit; and a control unit configured to cause the conveying unit to convey the continuous paper in the reverse direction by an amount equivalent to a predetermined reverse conveyance distance to adjust a bottom edge of the image in a conveying direction to a position on an upstream side of the image forming unit after the image is fixed onto the continuous paper by the fixing unit, and cause the conveying unit to convey the continuous paper in the forward direction and cause the image forming unit to resume image formation after completion of the conveyance in the reverse direction, wherein the image forming unit includes:

an image formation unit configured to form a toner image in accordance with image data; and a transfer unit configured to transfer the toner image onto the continuous paper, and wherein the reverse conveyance distance is at least a sum of a first distance between the fixing unit and the image formation unit, and a second distance from a point of transfer of the toner image formed by the image formation unit to the transfer unit, to a point of transfer of the toner image onto the continuous paper.

3. The image forming apparatus according to claim 2, wherein:

the image forming unit successively forms a first image and a second image, the first image and the second image being related to each other, the reverse conveyance distance is a sum of the first distance, the second distance, and a length of the first image in the conveying direction, and the control unit causes the image forming unit to form the first image and the second image in an overlapping manner in a same position on the continuous paper.

4. An image forming apparatus comprising:

a conveying unit configured to convey continuous paper in a forward direction from an upstream side toward a downstream side and in a reverse direction from the downstream side toward the upstream side;

an image forming unit configured to form an image on the continuous paper being conveyed in the forward direction by the conveying unit;

a fixing unit configured to fix the image formed by the image forming unit onto the continuous paper;

an adjusting unit configured to adjust the image forming unit while the continuous paper is conveyed in the reverse direction by the conveying unit; and a control unit configured to cause the conveying unit to convey the continuous paper in the reverse direction by an amount equivalent to a predetermined reverse conveyance distance to adjust a bottom edge of the image in a conveying direction to a position on an upstream side of the image forming unit after the image is fixed onto the continuous paper by the fixing unit, and cause the conveying unit to convey the continuous paper in the forward direction and cause the image forming unit to resume image formation after completion of the conveyance in the reverse direction, wherein the image forming unit includes:

an image formation unit configured to form a toner image in accordance with image data; and a transfer unit configured to transfer the toner image onto the continuous paper, and wherein the control unit causes the image formation unit to form a toner image of a next image while the continuous paper is conveyed in the reverse direction by the conveying unit.

5. The image forming apparatus according to claim 4, wherein, after the completion of the conveyance in the reverse direction, the control unit changes a timing to start conveyance of the continuous paper in the forward direction after the completion of the conveyance in the reverse direction, in accordance with a degree of progress in formation of the toner image of the next image.

* * * * *